US005449137A

United States Patent [19]

Bell et al.

[11] Patent Number: 5,449,137

[45] Date of Patent: Sep. 12, 1995

[54] DISPENSING BOTTLE MOUNTING BRACKET

[75] Inventors: Ronald F. Bell, Uniontown; Thomas Kearnes, Richfield, both of Ohio

[73] Assignee: Gojo Industries, Inc., Cuyahoga Falls, Ohio

[21] Appl. No.: 243,309

[22] Filed: May 16, 1994

[51] Int. Cl.[6] ..... A47K 1/08

[52] U.S. Cl. ..... 248/311.2; 215/396; 248/309.2; 248/312.1

[58] Field of Search ..... 248/309.2, 311.2, 313, 248/312, 312.1, 224.3, 224.4; 211/75, 72, 73, 89; 215/100 R, 101, 100 A

[56] References Cited

U.S. PATENT DOCUMENTS

| | | | |
|---|---|---|---|
| 1,361,339 | 12/1920 | Koblock | 248/309.2 |
| 2,883,139 | 4/1959 | Dobkin | 248/311.2 |
| 3,033,404 | 5/1962 | Adell | 248/311.2 X |
| 3,794,285 | 2/1974 | Barts | 248/311.2 |
| 4,015,810 | 4/1977 | Williams | 248/311.2 |
| 4,099,693 | 7/1978 | Blann | 248/311.2 X |
| 4,121,800 | 10/1978 | McClellan | 248/311.2 X |
| 4,305,533 | 12/1981 | Wightman et al. | 248/311.2 X |
| 4,736,920 | 4/1988 | Omessi | 248/311.2 |
| 5,105,958 | 4/1992 | Patton | 215/100 R |
| 5,294,018 | 3/1994 | Boucher | 215/100 A X |

*Primary Examiner*—Ramon O. Ramirez
*Assistant Examiner*—Korie H. Chan
*Attorney, Agent, or Firm*—Reese Taylor

[57] ABSTRACT

A mounting bracket for supporting a container of the type having a handle projecting from one surface of its body and forming a through opening between the handle and the body includes a back wall and an integral side wall which projects from the back wall and a locating member which projects from the back wall substantially parallel to the side wall so that it may engage the handle opening of the container. The back wall and side wall present a forward surface configured complementally to the outer configuration of the container so that the container may engage it when mourned on the locating arm. The locating member has an elongate rib along its lower edge to ensure snug engagement with the container and the side wall has a retention member which projects from its forward edge toward the locating member to prevent inadvertent dislocation of the container from the arm.

11 Claims, 4 Drawing Sheets

DISPENSING BOTTLE MOUNTING BRACKET

BACKGROUND OF THE INVENTION

This invention relates in general to mounting brackets and relates in particular to a mounting bracket for mounting a bottle or container, of the type having a handle projecting from one surface of the container body and forming a through opening between the handle and the container body, to a vertical surface.

DESCRIPTION OF THE PRIOR ART

Many products such as soaps, lotions, etc., are packaged and sold in bottles or containers, many of which presently are of the plastic, blow molded type. While such containers take many sizes, shapes and configurations, many of them have some common characteristics. Specifically, they generally include a container body and carrying handle molded to the container body and projecting from one surface thereof. The handle is formed so as to create an opening between the body and the handle itself so that one desiring to pick up or carry the container may slip his or her fingers through the opening and grasp the handle.

In many instances, also, these containers may include a pump unit mounted to the top in which instance the pump unit is usually secured to a threaded neck or projection on the top of the container and material may be dispensed directly from the container through the pump unit by simply depressing or pumping the same.

These containers generally can be used in a number of ways. They can, of course, be supported on a flat surface following which, if they are equipped with a pump, the pump can be activated to dispense material. They also can be utilized without the pump whereby the top cap on the projecting neck may be removed and the material is simply poured from the container.

In any event, it is often desirable to store these units out of the way or off of the work surface. They therefore may often be hung on walls or other vertical surfaces adjacent their point of use. The prior art includes hooks, shelves and basket type arrangements which receive and support the container body itself, to store it out of the way.

While these methods of storage are presumably adequate for the purposes for which they have been designed, it has been found that, particularly with a pump type container, it is desirable to be able to store the container readily for storage purposes and in some instances, to be able to actually use the container by activating the :pump unit while the device is in the stored mode.

Storage on a shelf or in a basket is not entirely satisfactory for these purposes because they are costly and difficult to clean. Storage by a hook or anything which engages the neck, of course, would eliminate the possibility of actually operating the pumping mechanism, and also tends to secure the container at its weakest point which is the neck. In that regard, the neck finish of the container is dimensionally critical and any damage thereto is to be avoided. Thus, due to the material commonly used, cold flow and distortion is a problem if significant stress is imparted to this area. This can distort and deform the threads leading to failure of the container.

Accordingly, then it has been thought desirable to provide a mounting bracket for a container of this type which secures the container out of the way when out of use but which also adequately supports the container and without damage thereto so that it may be used when in the "storage" position. In that regard, the container handle is the portion of the container normally designed to support the container weight so that it is desirable to support the container in this manner.

SUMMARY OF THE INVENTION

It has been found, therefore, that the aforementioned objects can be achieved by providing a mounting bracket which essentially is an integral unit comprising a back wall and a side wall projecting forwardly from the back wall with both the side wall and the back wall having forwardly presented surfaces which are arcuate in nature and which form a continuous concave surface substantially approximately the outer convex surface of the container itself.

It has further been found, that such a bracket can be provided with a locating member also projecting forwardly from the back wall and being disposed substantially parallel to the side wall and wherein the locating member can be formed or sized to approximate the size and configuration of the opening formed by the handle of the container and the body of the container.

It has further been found, that such a locating member can be provided with an elongate rib extending along its bottom edge so as to insure a substantially snug fit even if the opening between the container handle and the container body is, or becomes, in use, slightly oversized. This feature also permits the bracket to accommodate the normal molding tolerances encountered in blow molding such containers.

It has further been found, that the projecting side wall member can be provided with a retention member taking the form of a slight projection which extends out from the leading or projecting edge of the side wall member in substantial parallelism with the back wall so as to retain the container and discourage its inadvertent movement along the axis of the location member, particularly when the pump unit is used when the container is in the storage position.

It has further been found that the side wall may be provided with an overhanging top extension which projects along at least a part of the transverse dimension of the back wall so as to trap the handle between the projecting member and the forward face of the side wall to further secure the container in place.

Accordingly, production of an improved mounting bracket of the character described becomes a principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
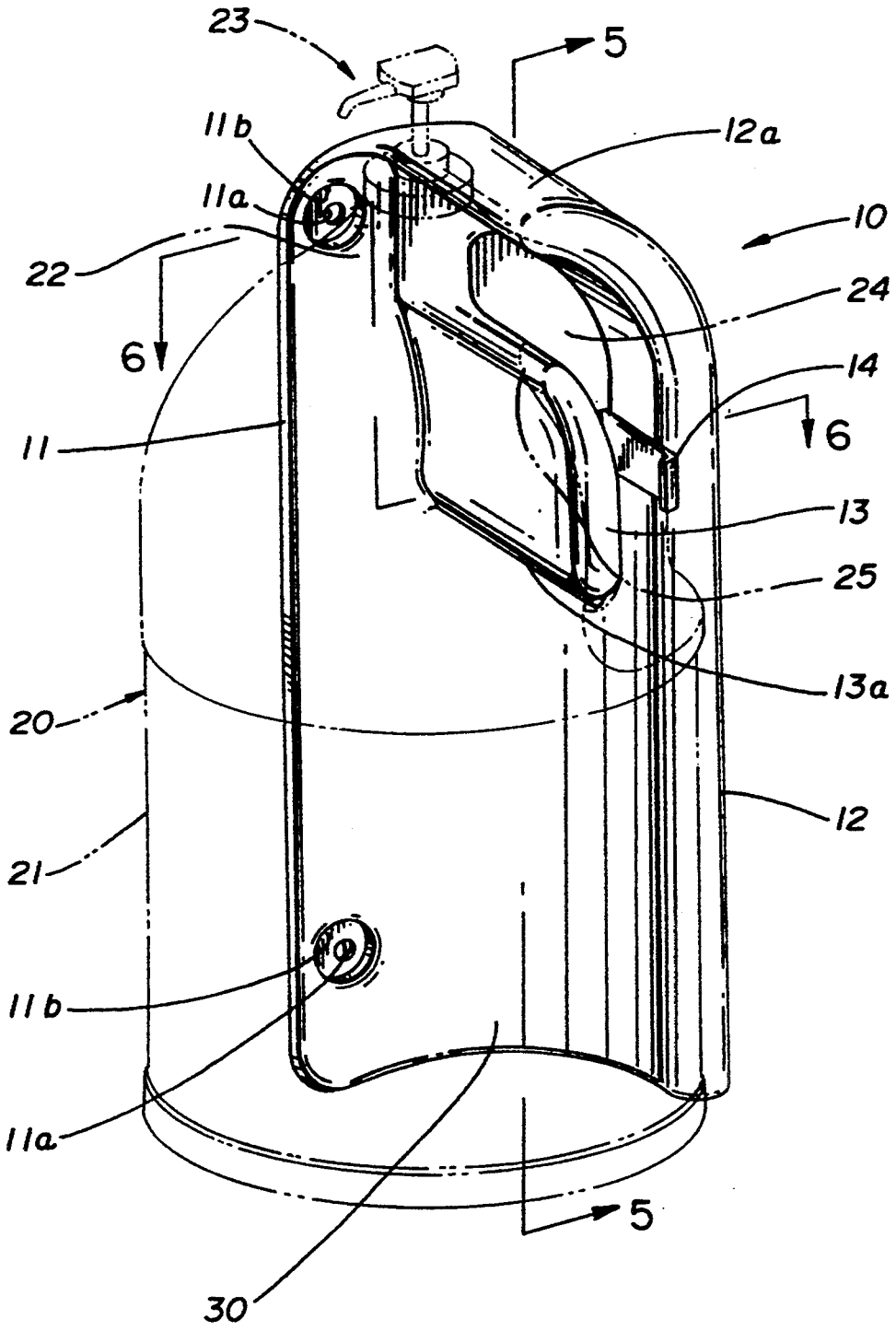
FIG. 1 is a perspective view of the improved bracket showing a container of the type referred to herein mounted thereon.
Figure 2:
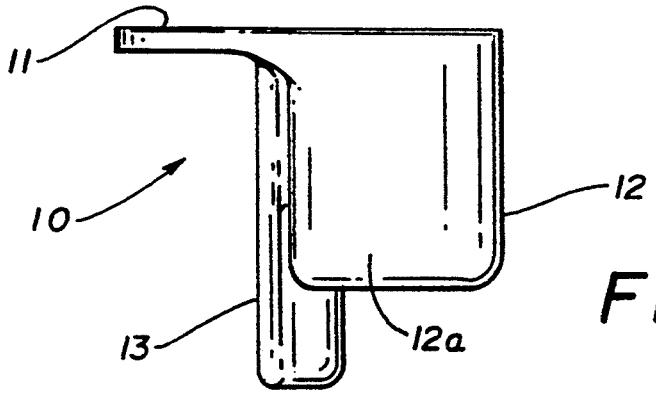
FIG. 2 is a top plan view of the improved mounting bracket.
Figure 3:
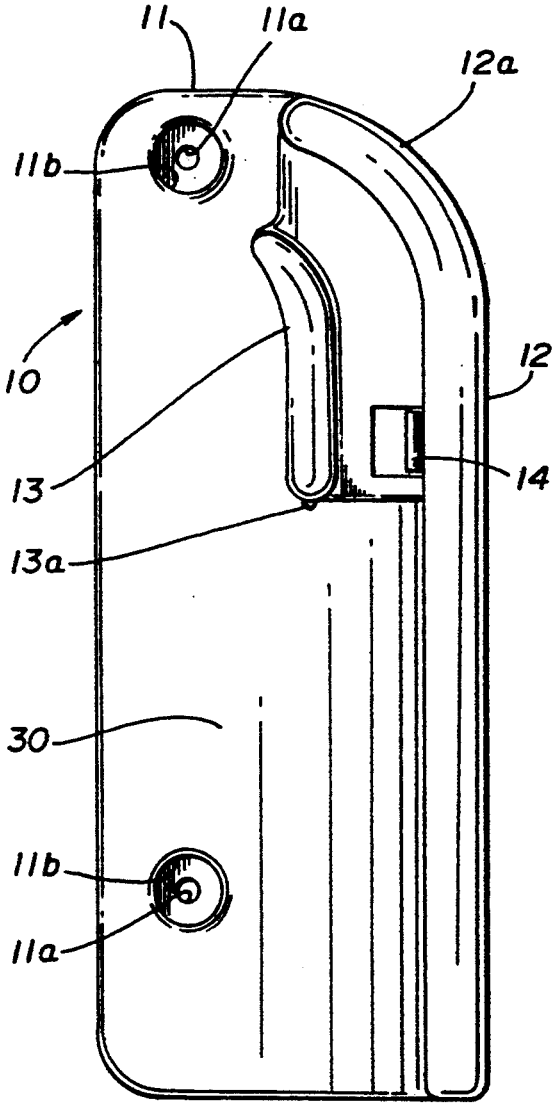
FIG. 3 is a front elevational view of the improved mounting bracket.
Figure 4:
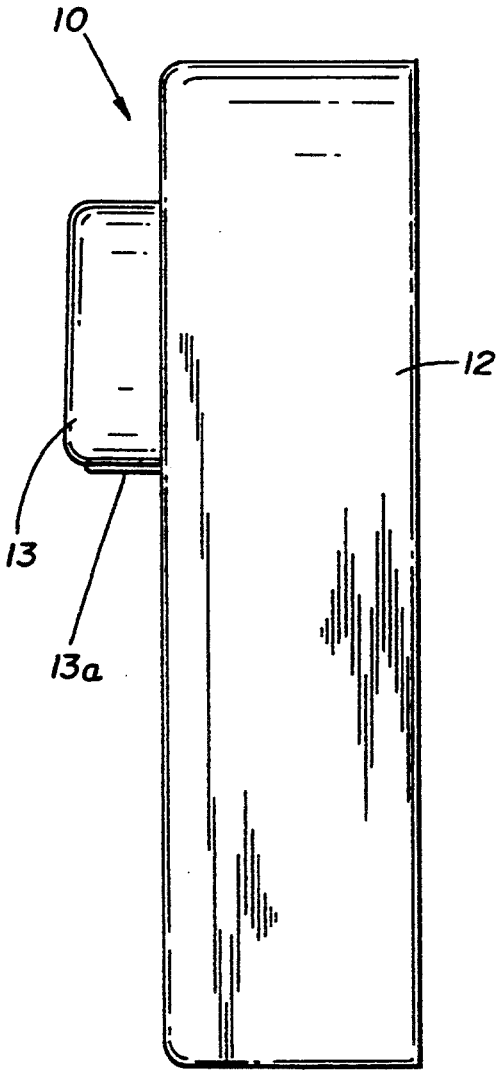
FIG. 4 is a side elevational view of the improved mounting bracket taken from the right of FIG. 3.
Figure 6:
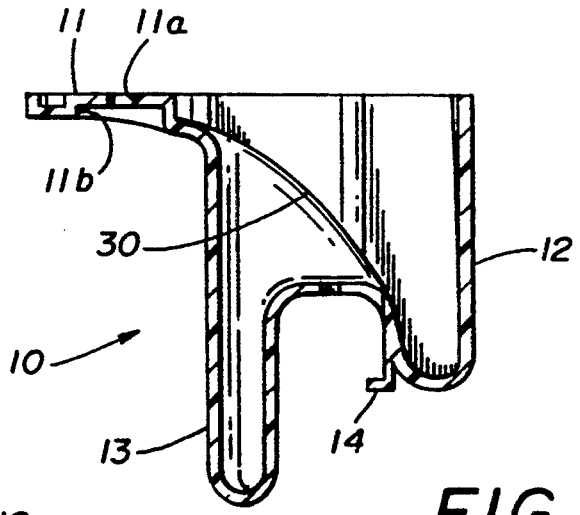
FIG. 6 is a sectional view taken along the line 6—6 of FIG. 1.
Figure 5:
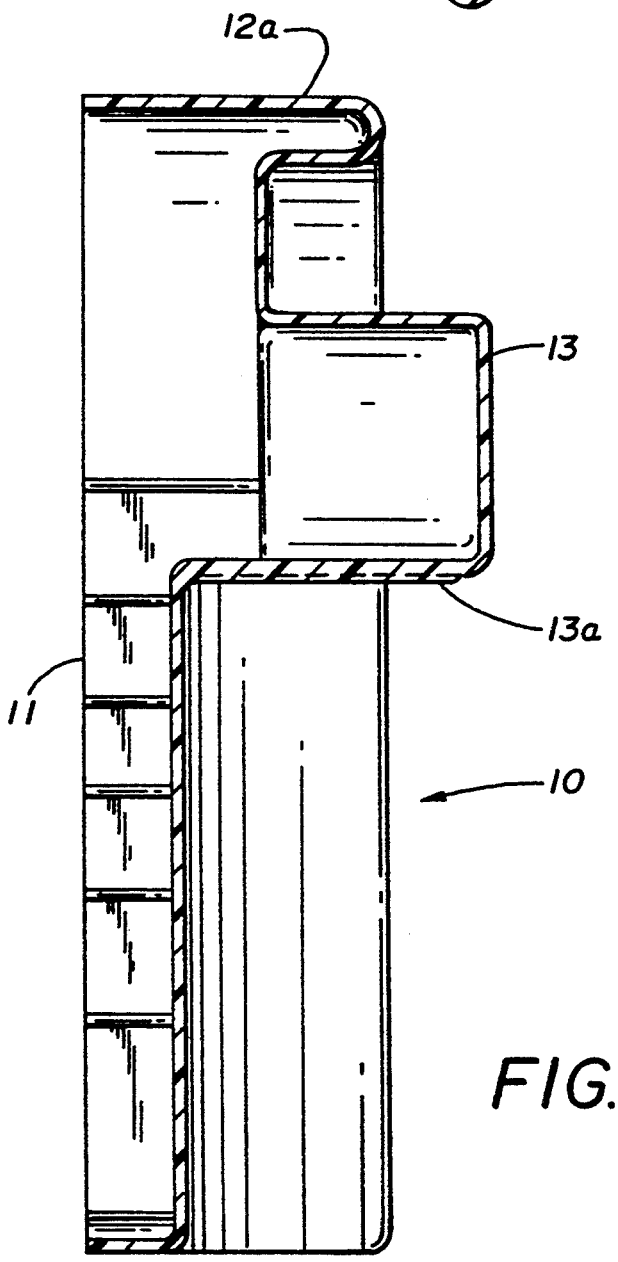
FIG. 5 is a sectional view taken along the line 5—5 of FIG. 1.
Figure 7:
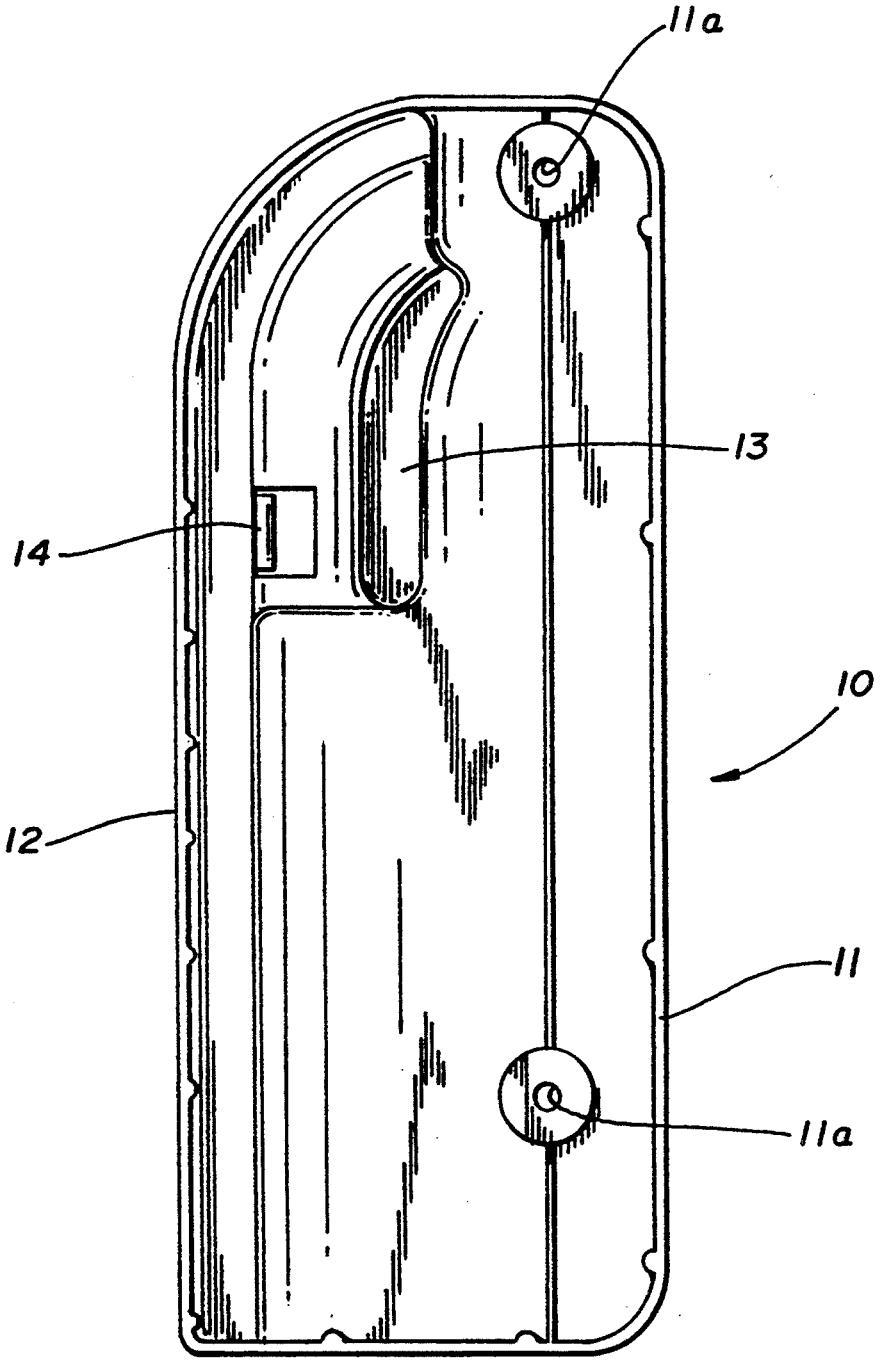
FIG. 7 is a rear elevational view.

Referring first to FIG. 1, it will be seen that the mounting bracket is generally designated by the numeral 10, while a typical container is generally designated by the numeral 20.

The container, as can be seen., includes a container body 21, a neck 22 and a pump assembly 23, with pump assembly being threaded or otherwise secured to the neck 22.

The container also has an integral handle 24 which projects from one side of the container body and forms an opening 25 between the container body 21 and the handle 24.

Further, description of the container itself and the pump assembly 23 will not be entered into herein inasmuch as containers and pumps of this nature are generally well known in the industry.

The mounting bracket 10 includes a back wall 11 and a side wall 12 which projects out from the forward face of the back wall 11 substantially normally to the plane of the back wall. As can be seen clearly in FIG. 1 of the drawings, the back wall 11 and the side wall 12 have forwardly facing surfaces which blend together to form a concave surface generally indicated by the numeral 30 in FIG. 1 of the drawings. This is intended to approximate the configuration of the container body 21 so that a relatively snug complemental fit is insured between the outer surface of the container 20 and the forwardly facing wall surface 30 of the bracket 10.

It should also be noted, that the back wall 11 is provided with through apertures 11*a*, 11*a*, which serve as screw receiving openings for mounting purposes to a vertical surface such as a wall. Countersunk recesses 11*b*, 11*b* are also provided so as to avoid having the screw heads project beyond surface 30. It will be understood that with other bracket configurations such as a flat rear surface other mounting means, such as adhesive, etc., could also be employed.

Still referring to FIGS. 1 through 6 of the drawings, it will be noted that projecting outwardly from the back wall 11 is a locating member 13. This locating member 13 is dimensioned, configured and sized so as to substantially approximate the size of the opening 25 between the container handle 24 and the container body 21 and it is contemplated, as clearly shown in FIG. 1 of the drawings, that the container may be fitted onto the mounting bracket by slipping the container onto the locating member 13 toward the rear wall 11. It will be noted that when this has been done, the outer surface of the body 21 of container 20 will nest against the concave surface 30 of the forward faces of the back and side walls 11 and 12.

It will also be noted that the side wall 12 has a projecting extension 12*a* at its top end. This extension extends a distance along the back wall 11 and projects outwardly therefrom and from side wall 12 to overhang locating member 13. It thus serves, with locating member 13, to enclose and trap the handle 24 between locating member 13 and the forward face of the side wall 12.

It will thus be seen that by this arrangement, no stress is placed on the neck of the container or the pumping unit 23 but the container is securely held in the bracket.

It will also be noted that the length of the body of the bracket 10, formed by back wall and side wall 12, is substantially the same as the height dimension of the container 20. Thus, when the container is secured, as illustrated in FIG. 1, the natural tendency of the bottle to swing about its long axis or, more precisely, about its mounting point on the locating member 13, will be resisted by the side wall 12. In that regard, it will be noted that the center of gravity of the container 20 is not at the mounting point or point of support provided by locating member 13, but is substantially through the center of the bottle along a vertical line extended from the pumping unit 23.

As previously noted, many of these containers are made of extrusion blow molded plastic and tolerances are not precise. They also carry a considerable weight of material in some instances and therefore have a tendency to "stretch" or "grow" when hung in a manner such as illustrated in the drawings. Therefore, the locating member 13 has an elongate rib 13*a* molded along its bottom edge surface and, in the event the opening 25 is off tolerance or becomes oversized through stretching or growing, the rib 13*a* will still insure a fairly tight fit. If, of course, the opening is undersized for any reason, the fact that these containers are commonly made out of relatively soft material in thin wall section will still permit the container 20 to be slipped over the locating member 13 inasmuch as the container material will simply deform slightly to accommodate the rib.

Thus, it will be seen that, when mounted as shown in FIG. 1 of the drawings, movement of the container toward the mounting surface will be resisted by back wall 11. Movement laterally, or movement about the center of gravity of the container will be resisted by side wall 12, the snug fit of locating member 13 and the close engagement of projection or extension 12*a*.

It is also contemplated that the mounting bracket of the present invention may have utility not merely to store the container but to permit the container to be actually used in its storage position. In that regard, of course, once the container is securely mounted on the mounting bracket 10, one could simply depress the pump mechanism 23 and dispense the contents. However, in view of the weight and mass of the container, in some instances there may be a tendency, when the container is actually being used in this mode, for it to "walk" off of the locating member 13. To that end, a retention member 14 is molded into the projecting edge surface of the side wall 12. This retention member projects slightly outwardly toward locating member 13 and tends to trap the handle 24 and prevent it from inadvertently sliding outwardly and completely off of the locating member 13.

Thus, the mounting arrangement disclosed herein is such that both static and dynamic loads are accommodated and the container is supported at its strongest point, i.e., the handle.

While a full and complete description of the invention has been set forth in accordance with the dictates of the Patent Statutes, it should be understood that modifications can be resorted to without departing from the spirit hereof or the scope of the appended claims.

Thus, the embodiment of the invention which has been illustrated and described as having a concave forwardly presented surface to complement the configuration of the container illustrated in the drawings. The bracket could also be configured to accommodate other container configurations if desired.

What is claimed is:

1. A mounting bracket for mounting a container of the type having a handle projecting from one surface of the container body and forming a through opening between the handle and the container body, the mounting bracket comprising:

a) an elongate body having 1) a back wall and 2) an integral, projecting side wall disposed substantially normally to the plane of said back wall;

b) said body having a length dimension approximately equal to the height dimension of the container;

c) a locating member projecting from said back wall in substantially parallel relationship with said side wall and spaced therefrom; and d) said locating member being sized and configured substantially complementally with the dimensions and configuration of the opening between the handle and the body of the container for insertion therein and support of the container.

2. The mounting bracket of claim 1 further characterized by the presence of a retention member projecting from the projecting edge of said side wall toward said locating member in substantial parallelism with said back wall.

3. The mounting bracket of claims 1 or 2 wherein said back wall and side wall have forwardly facing surfaces; said forwardly facing surfaces being arcuate to form a forwardly facing continuous concave surface.

4. The mounting bracket of claim 3 further characterized by the presence of mounting means carried by said back wall.

5. The mounting bracket of claim 3 wherein said back wall and said side wall have upper and lower ends; said upper end of said side wall extending along the upper end of said back wall and overhanging at least a portion of said locating members.

6. The mounting bracket of claims 1 or 2 wherein said back wall and said side wall have forwardly facing surfaces configured substantially complementally with the outer configuration of the container body.

7. The mounting bracket of claim 6 further characterized by the presence of mounting means carried by said back wall.

8. The mounting bracket of claim 6 wherein said back wall and said side wall have upper and lower ends; said upper end of said side wall extending along the upper end of said back wall and overhanging at least a portion of said locating member.

9. The mounting bracket of claims 1 or 2 wherein said back wall and said side wall have upper and lower ends; said upper end of said side wall extending along the upper end of said back wall and overhanging at least a portion of said locating member.

10. The mounting bracket of claims 1 or 2 further characterized by the presence of mounting means carried by said back wall.

11. The mounting bracket of claims 1 or 2 further characterized by the presence of an elongate rib extending along the bottom edge of said locating member.

* * * * *

UNITED STATES PATENT AND TRADEMARK OFFICE

CERTIFICATE OF CORRECTION

PATENT NO. : 5,449,137

DATED : September 12, 1995

INVENTOR(S) : Ronald F. Bell et al.

It is certified that error appears in the above-identified patent and that said Letters Patent is hereby corrected as shown below:

In the Abstract, line 11, delete "mourned" and substitute therefor ---mounted---.

Signed and Sealed this

Nineteenth Day of December, 1995

*Attest:*

BRUCE LEHMAN

*Attesting Officer*

*Commissioner of Patents and Trademarks*